US005833012A

United States Patent [19]

Pierce et al.

[11] Patent Number: 5,833,012

[45] Date of Patent: Nov. 10, 1998

[54] SCRAPER AND DRAG ATTACHMENT

[76] Inventors: Kevin J. Pierce, R.R. #1, Box 124PP; Michael J. Pierce, R.R. #1, Box 122, both of Grand Forks, N. Dak. 58201; Karen Dufault, R.R. #1, Box 45B, E. Grand Forks; Wayne A. Pierce, R.R. #1, B ox 45C, East Grand Forks, both of Minn. 56721

[21] Appl. No.: 757,028

[22] Filed: Nov. 26, 1996

[51] Int. Cl.[6] ..... E02F 3/76

[52] U.S. Cl. ..... 172/199; 172/799.5

[58] Field of Search ..... 172/196, 197, 172/199, 445.1, 311, 664.5, 799.5, 272, 188; 404/118

[56] References Cited

U.S. PATENT DOCUMENTS

| | | | |
|---|---|---|---|
| 3,348,323 | 10/1967 | Purdy | 172/199 X |
| 4,055,222 | 10/1977 | Runte | 172/799.5 |
| 4,217,962 | 8/1980 | Schaefer | 172/799.5 X |
| 4,700,786 | 10/1987 | Berry | 172/799.5 |
| 4,836,295 | 6/1989 | Estes | 172/197 X |
| 4,924,945 | 5/1990 | Mork | 172/197 |
| 5,289,880 | 3/1994 | Barto | 172/799.5 |

*Primary Examiner*—Terry Lee Melius
*Assistant Examiner*—Robert Pezzuto
*Attorney, Agent, or Firm*—Robert E. Kleve

[57] ABSTRACT

The invention comprises a scraper and drag attachment for a tractor. The attachment has a main frame with a hitch at it forward end for attachment to a tractor. A scraper is fixed to the main frame behind the hitch and a first pivotal frame is pivotally mounted to the main frame behind the scraper. A pair of wheel frames each having a wheel rotatably mounted thereon are individually pivotally mounted to the main frame behind the scraper and laterally adjacent one another. A piston and cylinder is pivotally connected between the first frame and one of the wheel frames and a rod has its end pivotaly connected between the other wheel frame and the first frame; and a second piston and cylinder is pivotally connected between the main frame and the first frame, whereby the first piston and cylinder may be actuated to telescope or retract to pivot the one wheel frame and its wheel at an up or down, relative to the second wheel frame and its wheel, to an adjusted angle, and the second piston and cylinder may be actuated to raise or lower the first frame and wheel frames with the wheel frames and wheels remaining at their adjusted angular position relative to one another. A drag is pivotally mounted on a second frame which second frame is pivotally mounted to the main frame and a pair of chains are adjustably connected between the second frame and first frame whereby raising and lowering the first frame will raise and lower the drag with drag at a height relative to the device depending upon, the chain adjustment between the first frame and second frame.

3 Claims, 3 Drawing Sheets

SCRAPER AND DRAG ATTACHMENT

This invention relates to earth working equipment, more particularly, the invention relates to earth working scraper and drag equipment.

It is an object of the invention to provide a novel scraper and drag earth working attachment which will provide a dual function of first scraping and then applying drag upon the earth which combination attachment may be towed behind a vehicle such as a tractor.

It is another object of the invention to provide a novel combination scraper and drag attachment to a tractor having a scraper and drag mounted on adjustable wheels, with the height the wheels relative to one another being adjustable, and with the height of the drag being adjustable relative to the wheels and scraper.

It is a further object of the invention to provide a novel device for attachment to the back of towing vehicle having a scraper and drag mounted wheels, with the wheels and drag being adjustable in height relative to the scraper.

Further objects and advantages of the invention will become apparent as the description proceeds and when taken in conjunction with the accompanying drawings wherein:

BRIEF DESCRIPTION OF THE PREFERRED EMBODIMENT

Briefly stated, the invention comprises a combination earthworking scraper and drag attachment for towing behind a tractor. The attachment has a main frame with adjustable wheels adjustable relative to the main frame and to one another. A scraper is fixed to the main frame, and first and second frames are each individually pivotally mounted to the main frame and scraper. The first frame has a pair of arms extending rearward with one arm extending over one of the adjustable wheels and the other arm extending over the other of the adjustable wheels. A hydraulic piston and cylinder is connected between the one arm and the one adjustable wheel and a link plate pivotally connects the other arm to the other adjustable wheel whereby actuation of the hydraulic piston and cylinder can raise or lower the one wheel relative to the other. A drag is mounted to the rear of the second frame behind the scraper and an adjustable linkage is connected between the first frame and second frame whereby the second frame and drag may be raised or lowered relative to the first frame by adjusting the linkage. A second hydraulic piston and cylinder is connected between the first frame and the main frame whereby the first frame may raise or lower the second frame and the adjusted wheels and adjusted drag relative to the main frame.

Figure 1:
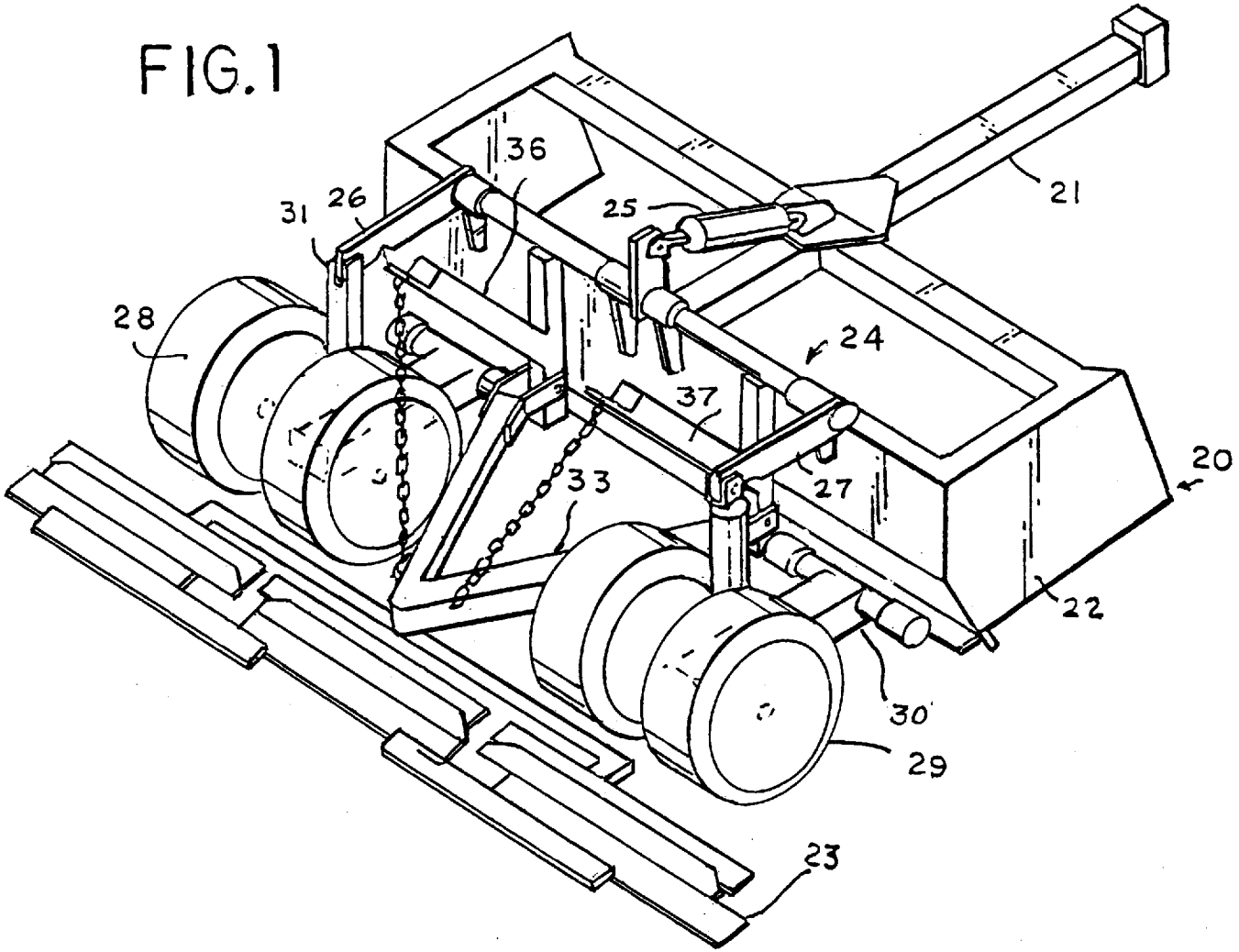
FIG. 1 is a perspective view of the combination scraper and drag earth working attachment invention.
Figure 2:
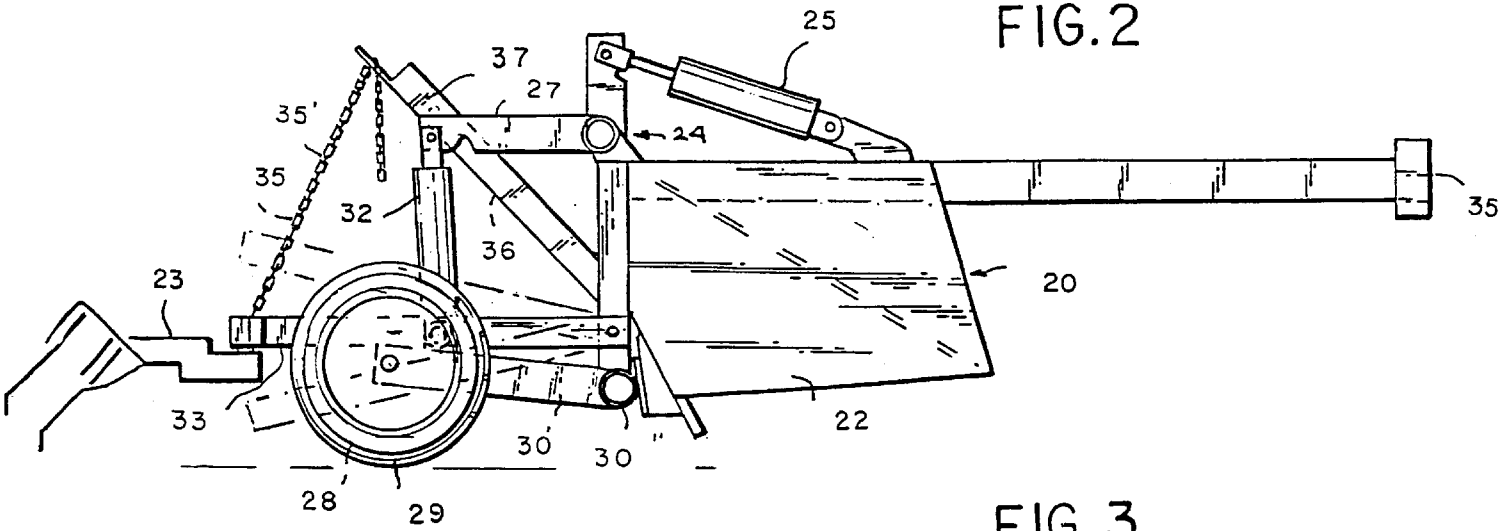
FIG. 2 is a side elevational view of the combination scraper and drag earth working implement attachment invention.
Figure 3:
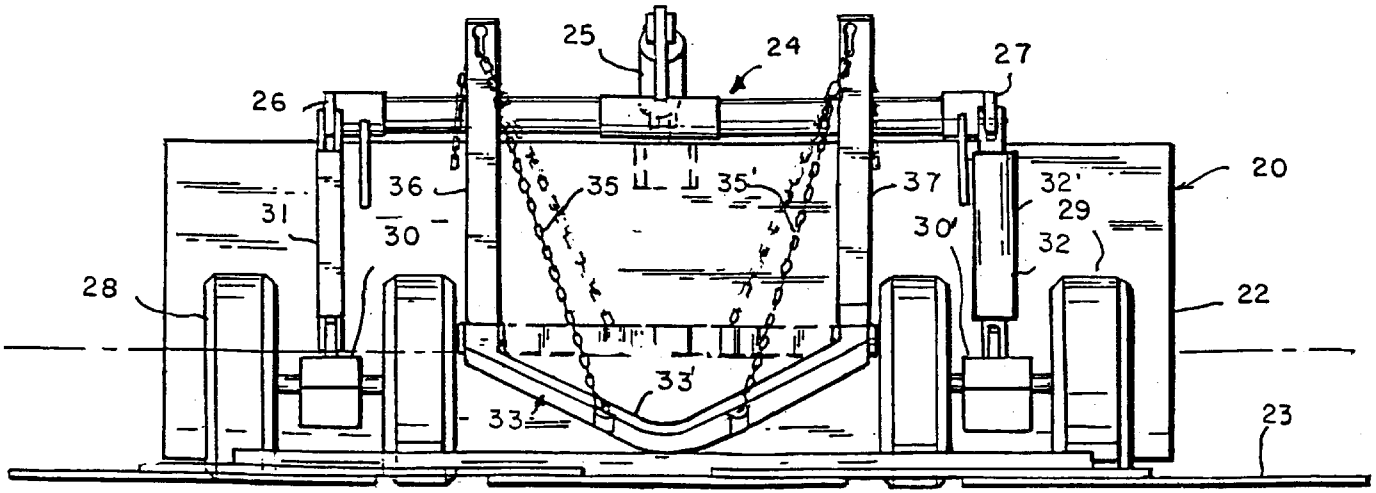
FIG. 3 is a front elevational view of the combination earthworking scraper and drag attachment invention.
Figure 4:
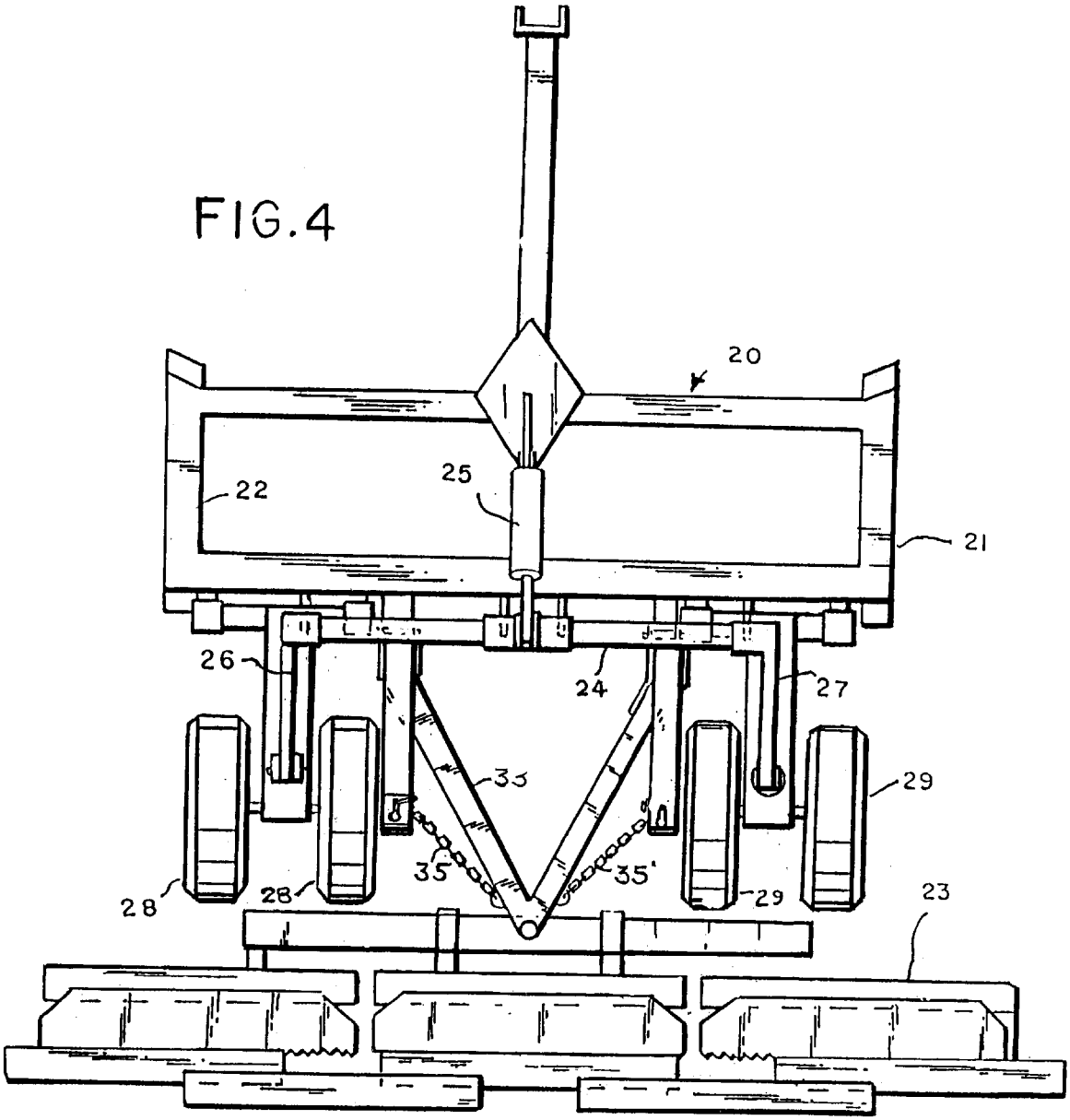
FIG. 4 is a top plan view of the combination earthworking scraper and drag attachment invention.

Referring more particularly to the drawings, in FIGS. 1–4, inclusive, the combination scraper and drag attachment invention 20 is illustrated having a frame 21 and a scraper 22 fixed to the main frame 21 and a drag member 23 attached at the rear of the invention. A first frame 24 has a rod 24', which rod is pivotally mounted in sleeves 21', which sleeves are fixed to the rear of the scraper. A hydraulic piston and cylinder 25 has its cylinder pivotally mounted to the main frame 21 and its piston pivotally mounted to the first frame 24. The first frame 24 has a pair of lever arms 26 and 27 fixed to the outer ends of the rod 24' and extend rearward. A pair of wheels 28 and 29 are rotatably mounted on wheel frames 30 and 30', and the wheel frames 30 and 30' are pivotally mounted to the main frame and back of the scraper at pivots 30" to enable each wheel frame to individually pivot on the back of the scraper and main frame. The one wheel frame 30 has a pivot rod 31 with its outer ends-pivotally connected between the one wheel frame 30 and the one lever arm 26. The other wheel frame 30' has a second piston and cylinder 32 with the piston 32' pivotally connected to the other lever arm 27 and its cylinder 32" pivotally connected to the other wheel frame 30'.

A second V frame 33 has a separate second pivotal mounting to the scraper and main frame at pivots 34 and 34'. A pair of diagonal arms 36 and 37 have their lower ends fixed to the back of the scraper and fixed in relation to the main frame. A pair of chains 35 and 35' have the one ends fixed to the second V frame 33 and their other ends adjustably mounted in slots 36' and 37' at the outer ends of the arms 36 and 37. The second V frame 33 has a pivot 33' at its rearward end and the drag member 23 is pivotally mounted to the second V frame at a location intermediate the ends of the elongated drag member 23 at pivot 33'.

The second, hydraulic piston and cylinder 32, connected between the second wheel frame 30 and the lever arm 27 of the first frame 24, can be hydraulically actuated to raise or lower the second wheel frame 30 and its wheel relative to the first wheel frame 30 and its wheel 28 and its rod connection to the other lever arm 26 of the first frame 24 to place the wheels at a lateral angle to one another. The first hydraulic piston and cylinder 25 being pivotally connected between the main frame 21 and the first frame 24 and its lever arms 25 and 26 can be hydraulically actuated to either raise or lower the lever arms 25 and 26 simultaneously and thereby raise or lower the second V frame and the drag member about its second pivotal connections 34 and 34' to the main frame to thereby raise and lower the drag member 23 mounted at the end of the V frame, and by raising and lowering the lever arms to raise and lower the wheel frames and wheels at their selected angle to one another selected by the adjustment of the second hydraulic piston and cylinder 32.

A hitch member 38 is mounted to the front of the main frame 21 in front of the scraper 22 for towing the scraper and drag member on the wheels 28 and 29.

OPERATION

The combination scraper and drag attachment operates as follows:

The hitch 38 will be attached behind a tractor and the attachment may be used to scrape fairways-of golf courses and the like level with the scraper and then follow with the drag member to smooth the ground further.

The wheels 28 and 29 will be raised and lowered relative to the main frame 21 by actuation of the hydraulic piston and cylinder 25 to telescope or retract the piston relative to the cylinder to pivot both wheels about their pivotal mountings 29' and 30' to the main frame and scraper along the back of the scraper, with the raising or lowering of the wheels acting to change the depth of the cut of the blade like front edge 42 of the scraper into the ground as the attachment is towed along the ground, by the action of piston and cylinder raising and lowering the first frame to thereby raise and lower the wheels. This action through of raising and lowering the scraper and its blade also raises and lowers the second frame thereby raising and lowering them drag. The drag may be raised and lowered relative to the first frame scraper and main frame, and relative to the ground by adjusting its height of the rear end of the second V frame relative to the first frame and scraper. This is done by adjusting the links of the chains 35 and 35' in the slots 36' and 37' of the ends of the arms extending from the main frame and scraper. The drag may be lowered to place it into operation, together with the scraper operations to provide both operations simultaneously. Alternatively, it may be raised upward entirely above the ground and put out of operation and the scraper operated alone.

The wheels 28 and 29 may be adjusted relative to one another when it is desired to angle the scraper and or drag along the angular hills and angular terrain and it is found it is necessary to cut at a difference angle with respect to the grounds to create angular terrain for a golf course, for example, when one doesn't want the course flat. Also, it can be used with one corner of the scraper blade lowered to create a slope in the course.

Thus, it will be seen that a novel combination scraper and drag attachment has been provided which can be towed behind a tractor and which can be operated in a variety of different ways to perform different earthworking functions.

It will be obvious that various changes and departures may be made to the invention without departing from the spirit and scope thereof; and accordingly, it is not intended that the invention be limited to that specifically described in the specification or as illustrated in the drawings, but only as set forth in the appended claims wherein:

What is claimed is:

1. A scraper and drag implement attachment for a tractor comprising a main frame, a scraper fixed to said main frame, a first pivotal frame and a second frame, said first pivotal frame being pivotally mounted adjacent said scraper, said second frame having a pair of legs extending forward with their forward ends pivotally mounted adjacent the rear of the scraper, an elongated drag member pivotally mounted intermediate its length to the rearward end of the second frame, arm means fixed adjacent the rear of the scraper and extending over the second frame, said arm means having adjustable connection means at its rearward ends, elongated connection means extending from the rearward portion of the second frame upward to the arm means and adjustably connected to said adjustable connection means to adjustably support the rear of the second frame at a selected height relative to the scraper, a pair of wheel frames each pivotally mounted at their one ends adjacent the scraper, each of said wheel frames having a wheel rotatably mounted thereon adjacent the other end of the wheel frames, a pair of wheel frame arms mounted to said first pivotal frame and extending rearward with hydraulic means to pivot said first frame to pivot said flame arms upward and downward, link means pivotally connected at its one end to one of said wheel frames with its other end pivotally mounted to one of the wheel frame arms to raise and lower the one wheel frame, a fluid piston and cylinder means connected between the other wheel frame and the other wheel frame arm to adjustably raise and lower the other wheel frame and other wheel relative to the one wheel frame, whereby said hydraulic means act to raise and lower the frame arms simultaneously to raise and lower the wheels simultaneously, with said fluid piston and cylinder means adjusting the height of the one wheel frame relative to the other while raising and lowering the wheel frames simultaneously.

2. A scraper and drag implement attachment according to claim 1 wherein said pair of wheel frames are mounted in spaced relation to one another oil opposite sides of the rear of the scraper with said second frame for said drag mounted between said wheel frames forming a generally V shape with the pair of arms for supporting the chains of said V frame are also mounted between the wheel frames adjacent the back of the scraper.

3. A scraper and drag implement attachment for a tractor comprising a main frame, a scraper fixed to said main frame, a first pivotal frame and a second generally V shaped frame, said first frame being pivotally mounted adjacent the rear of the scraper above the V shaped frame, said V shaped frame having a pair of legs extending forward with their forward ends pivotally mounted adjacent the rear of the scraper and with their rearward end forming a generally V shape, a elongated drag member pivotally mounted intermediate its length to an apex of the V shape, a pair of arms fixed adjacent the rear of the scraper on opposite sides of the apex of the V shaped frame and above the V shaped frame and extending rearward with their rearward ends having slots, a pair of chains having their lower ends attached to the V shaped frame at least near the apex and their upper portion attached in the slots of the arms to adjustably support the V frame at a selected heights relative to the scraper about their pivotal mounting, a pair of wheel frames each pivotally mounted adjacent the rear of the scraper at their one ends on opposite sides of the V frame, each of said wheel frames having a wheel rotatably mounted at their other ends, a pair of wheel frame arms on opposite sides of the V frame fixed to the first pivotal frame at their one ends at the rear of the scraper above the wheel frames with hydraulic means to pivot the first frame and frame arms upward and downward, a link plate having one end pivotally attached to one of the wheel frames and its other end extending upward and pivotally attached to one of the wheel frame arms of the pivotal first frame to raise and lower the one wheel frame, a fluid piston and cylinder pivotally connected to the other wheel frame and wheel frame arm to adjustably raise and lower the other wheel frame relative to the one wheel frame, said hydraulic means acting to raise and lower the fast frame and frame arms simultaneously to raise and lower the wheels simultaneously, with said fluid piston and cylinder adjusting the height of said other wheel frame relative to said one wheel frame while raising and lowering both wheel frames simultaneously.

* * * * *